US008573284B2

(12) United States Patent
Schmitz

(10) Patent No.: US 8,573,284 B2
(45) Date of Patent: Nov. 5, 2013

(54) CASTING MOLD

(75) Inventor: Ludwig Schmitz, Vechta (DE)

(73) Assignee: KME Germany AG & Co. KG, Osnabrueck (DE)

( * ) Notice: Subject to any disclaimer, the term of this patent is extended or adjusted under 35 U.S.C. 154(b) by 0 days.

(21) Appl. No.: 13/390,223

(22) PCT Filed: Aug. 9, 2010

(86) PCT No.: PCT/DE2010/000937

§ 371 (c)(1),
(2), (4) Date: Feb. 13, 2012

(87) PCT Pub. No.: WO2011/018076

PCT Pub. Date: Feb. 17, 2011

(65) Prior Publication Data

US 2012/0138256 A1 Jun. 7, 2012

(30) Foreign Application Priority Data

Aug. 14, 2009 (DE) ..... 10 2009 037 283

(51) Int. Cl.
*B22D 11/041* (2006.01)
*B22D 11/059* (2006.01)

(52) U.S. Cl.
USPC ..... 164/418; 164/17; 164/459

(58) Field of Classification Search
USPC ..... 164/17, 418, 459, 472
See application file for complete search history.

(56) References Cited

U.S. PATENT DOCUMENTS

| | | | | | |
|---|---|---|---|---|---|
| 3,349,836 | A | * | 10/1967 | Rossi | 164/418 |
| 3,437,128 | A | * | 4/1969 | Poppmeier | 164/459 |
| 4,421,570 | A | * | 12/1983 | Gravemann | 148/682 |
| 4,665,969 | A | * | 5/1987 | Horst et al. | 164/439 |

FOREIGN PATENT DOCUMENTS

| | | | |
|---|---|---|---|
| EP | 0 237 318 | | 9/1987 |
| FR | 2658440 | A3 * | 8/1991 |
| JP | 62068659 | A * | 3/1987 |
| JP | 62-114745 | | 5/1987 |
| JP | 2004-195517 | | 7/2004 |

OTHER PUBLICATIONS

International Search Report, issued in corresponding International Application No. PCT/DE2010/000937.

* cited by examiner

*Primary Examiner* — Kevin P Kerns
*Assistant Examiner* — Kevin E Yoon
(74) *Attorney, Agent, or Firm* — Kenyon & Kenyon LLP

(57) ABSTRACT

A casting mold made of a copper material having a casting surface (2) that faces a metal melt, at least one expansion joint (3) being situated in the casting surface (2); the expansion joint (3) having a width (B) that is so small that, during the casting process, no metal melt penetrates into the expansion joint (3).

11 Claims, 3 Drawing Sheets

CASTING MOLD

Figure 1:
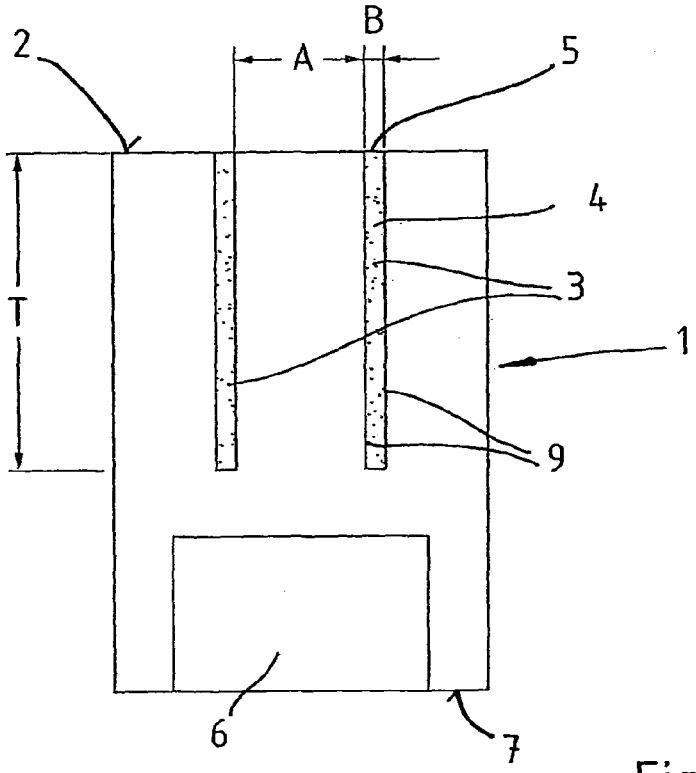

The present invention relates to a casting mold having the features according to the definition of the species in Claim 1.

During casting, especially continuous casting of metals, particularly of steel, casting molds of copper materials experience considerable heat stress, which is very high especially in the region of the casting bath level, and particularly in rapidly pouring continuous casting plants at clearly more than 2 m/min. This heat stress leads to material changes in the copper material or even to cracks, whereby the service life of the casting mold is greatly reduced.

In rapidly pouring continuous casting plants, for instance, in thin slab plants, a CuAg alloy is almost exclusively used these days as the copper material. Especially when new permanent mold plates are first used, after a relatively short time they have to be taken out of the manufacturing process and exchanged, since bulges appear in the casting or bath level region. Because of the bulges, the material lying behind them may flow, so that the bulge indeed becomes permanent, and the casting mold involved has to be reworked.

Copper materials based on a CuCrZr alloy, a CuCoBe alloy or a CuNiBe alloy demonstrate less severe bulging, but they tend to crack formation earlier than copper materials based on CuAg under temperature change stress. For this reason, copper materials based on CuCrZr, CuCoBe or CuNiBe are used only in exceptional cases, especially for the rapid continuous casting of slabs.

The present invention is based on the object of demonstrating a casting mold in which both bulging and crack formation at the casting bath level are able to be avoided, whereby time in use of casting molds is able to be increased, and in which copper material particularly of CuCrZr, CuCoBe or CuNiBe alloys become usable for rapid pouring.

This object is attained by a casting mold having the features set forth in Claim 1.

The dependent claims relate to advantageous further refinements.

It is important that at least one expansion joint be positioned in the casting surface, the expansion joint having a width that is so small that, during the casting process, no metal melt penetrates into the expansion joint. Because of the expansion joints it becomes possible for the copper material to expand freely in a plurality of directions, corresponding to the heat stress. This avoids one-sided bulges of the casting mold. Harmful internal stresses are able to be reduced or completely avoided. In addition, rapid cooling of the casting molds is possible without crack formation.

One special feature is that the width of the expansion joint is selected to be very small, namely, so small that a metal melt is not able to enter into the expansion joint based on its surface tension. Using the casting mold according to the present invention, different metal melts may be cast, but especially steel, aluminum or copper alloys.

The expansion joints have the function of compensating for the thermal expansion of the material regions that lie between the expansion joints, and of avoiding crack formation during rapid cooling. In standard fashion, chill molds are made flat on their contact side toward the metal melt, or having very slight surface textures, in which case, on an overall basis, there is still present an almost planar surface. These textures have a relatively slight effect on the conditions in the bath level of the metal melt. An expansion joint should not be understood as a surface texture, but basically has a substantially greater depth than width. The relationship between width and depth preferably amounts to at least 10:1, particularly 20:1 to 50:1. The expansion joints should preferably have a very low width, in a range of 0.1 to at most 0.4 mm. The width on the opening-out side should not be greater than 0.4 mm during the casting process, that is, at maximum thermal stress of the casting mold. Even at room temperature it is preferably not greater than 0.4 mm.

The width of the expansion joints does not depend only on the surface tension of the melt, but also on the distance of separation of the expansion joints. Primarily it has to be assured that no metal melt penetrates into the expansion joints. On the other hand, however, the expansion joint has to be wide enough to be able to compensate for the thermal expansion of bordering material regions. It is regarded as advantageous if the width, at least in the region of opening out, that is, at the region of the expansion joint close to the casting surface, becomes at least 90% smaller during the casting process compared to the width measured at room temperature.

The expansion joints are preferably situated, at a distance from one another, that is selected so that the expansion joints are closed by thermal expansion to a maximum extent on the opening-out side, during the casting process. This means that the expansion joints are open at room temperature, but dimensioned and situated in such a way that they close for the most part or completely because of thermal expansion.

The expansion joints may be situated parallel and/or transversely to the casting direction. The expansion joints may also be situated in certain patterns, for instance, in honeycomb shape or rhombus shape. The course of the expansion joints may be executed to be straight or curved. The expansion joints do not all have to have the same cross section or the same length. The design and positioning of the expansion joints depends on the specific application.

Depending on the position of the expansion joints, they may be arranged at deviating distances from one another. An attempt is made, however, to arrange the expansion joints in such a way that they close during the casting process on the opening-out side.

For technical manufacturing reasons, the sidewalls of the expansion joints may run parallel to one another at room temperature. It is basically also possible to develop the expansion joints as back tapers, or having a width which is somewhat greater in the direction toward the opening-out side than toward their joint base. The selection of the joint geometry is made a function of the temperature gradient in the respective region of the casting mold.

The expansion joints are supposed to contribute to freedom from stress within the casting mold. Therefore, the base of the joint of the expansion joints may be either at an angle to the sidewalls of the expansion joints, i.e. having corners, or they may be rounded to avoid stress peaks.

It is essential for the functioning of the stress compensation that the expansion joints have a certain minimum depth. In particular, the depth of the expansion joints should be dimensioned in such a way that the lowest, i.e. the lowest lying point of the expansion joints, is thermally as stress-free as possible because of cooling. The casting mold is cooled, as a general principle. To do this, cooling channels in the form of cooling grooves or cooling bores are applied to the rear side of the casting mold. The expansion joints are supposed to extend to a depth of the casting mold at which, because of the rear-side cooling during the casting process, no stresses occur that are conditioned on temperature and lead to bulging of the casting mold. For this purpose, the expansion joint may have a depth at its deepest location that amounts to at least 8 mm.

The depth of the expansion joints may decrease going downwards, i.e. in the casting direction, since the temperature loading decreases continuously with an increasing distance from the casting bath level. The expansion joint should be made long enough so that the joint base remains sufficiently stress-free. Thus, the joint base is able to run from top to bottom, having a decreasing depth at a shallow angle straight to the casting surface.

For a low-stress course it is particularly provided that the depth of the expansion joint decreases in the direction toward the ends of the expansion joints. In longitudinal section, the joint base may run in an arched manner. This applies particularly to the transition from a greater depth to the casting surface of the casting mold.

In one advantageous refinement, the expansion joints may be temporarily closed for the start of casting. For this, a filler may be provided, which is released from out of the expansion joints during the casting process. In this way, it is possible to provide expansion joints of relatively greater width which close only at increased temperatures or are reduced in width to such a great extent that no metal melt is able to penetrate into the expansion joint. As filler, one might name, for example, graphite paste.

Alternatively to expansion joints that are open in the direction of the casting surface, it is provided in another specific embodiment that the expansion joints are closed at their side of opening out. This may help as much in the casting start as filling with graphite paste. The closing of the expansion joints may come about, for example, in that the casting mold is furnished with a wear-reducing coating, which may be removed with progressive time of use of the casting mold. However, independently of the coating applied, expansion joints that are closed on the opening-out side also lead to a reduction or prevention of bulging, as well as to the reduction or prevention of crack formation during rapid cooling. Therefore, it is basically also possible to close the expansion joints at their opening-out side by a remelting method, for instance, by friction stir welding.

In the casting mold according to the present invention, a permanent mold plate, a permanent mold tube, a casting wheel, a casting roll or a pot may be involved. The idea, according to the present invention, of designing expansion joints at a width that is so small that, even during removal of a coating on the opening-out side, no metal melt is able to penetrate into the expansion joint, applies for all types of casting molds that come into contact with a metal melt, and is not limited to a certain geometry of the casting mold.

Expansion joints are arranged in the range of the highest temperature stress during casting. It is possible that the expansion joints begin above the casting bath level, or rather that an upper end of the expansion joints is located above the casting bath level. It is also conceivable that the expansion joints are situated completely below the casting bath level.

It is a particular advantage of the casting mold, according to the present invention, that, because of the geometrical design, copper materials based on CuCrZr, CuCoBe or a CuNiBe alloy is able to be used. It has turned out that, during casting using CuAg alloys as the copper material for casting molds, especially in rapid pouring, it cannot be prevented that, in the bath level region, the layers close to the surface of permanent mold plates are heated to temperatures above 350° C., whereby recrystallization of the copper material sets in. As a result, the copper material becomes coarse-grained and soft, and loses its capacity for resistance to erosion and other attacks. One special effect, that is determined in the case of CuAg materials, is the great bulging during first use. Local bulging in the bath level vicinity prevents the adjustment of permanent mold narrow sides during casting. When there is a renewed casting start, large gaps may be created between the narrow side and the broad face, near the bulging.

Copper materials based on CuCrZr, CuCoBe and CuNiBe do not change their material properties at temperatures present during casting, or only very gradually. However, these copper materials, too, experience inner thermal stresses because of the heat introduced during the casting process. The temperature fluctuations that suddenly appear because of sudden changes in the bath level height or at the end of the casting process, lead, in the case of these last mentioned copper alloys, very rapidly to cracks that limit, in an undesired manner, the spectrum of utilization of these copper alloys. However, using the present invention, it is possible to use particularly CuCrZr alloys having a chromium content of 0.65% and a zirconium content of 0.1% as well as CuCoBe alloys having a cobalt content of 1.0% and a beryllium content of 0.1% as well as CuNiBe alloys having a nickel content of 1.5 wt. % and a beryllium content of 0.2 wt. % even for rapid casting processes, particularly in continuous casting permanent molds.

Because of their small width, the expansion joints are able to be produced especially by machining, for instance, by using very thin saw blades. It is also possible to burn in the expansion joints using a laser, or to produce them using a suitable eroding method. Other processing forms as well as a combination of the production methods named in exemplary fashion are also not excluded.

Figure 2:
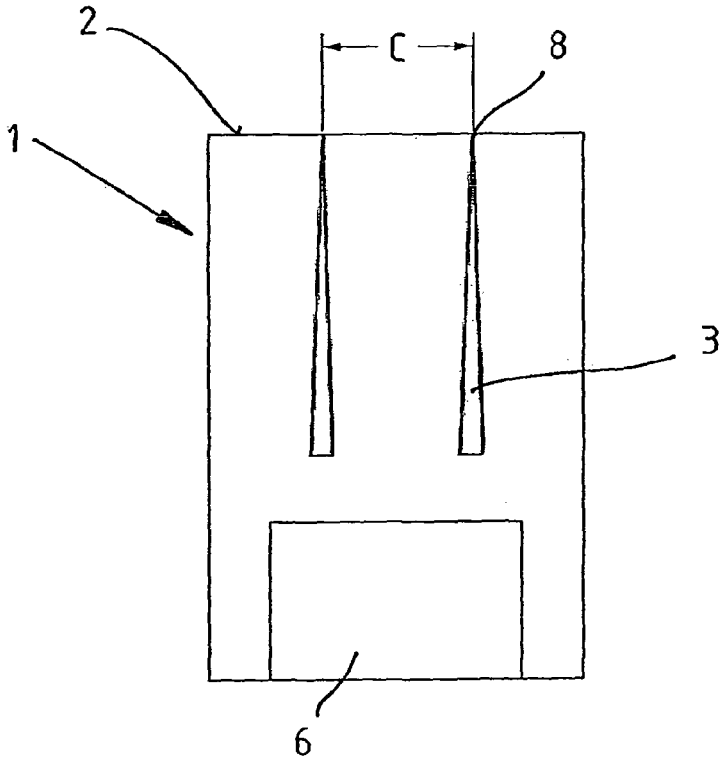
Figure 3:
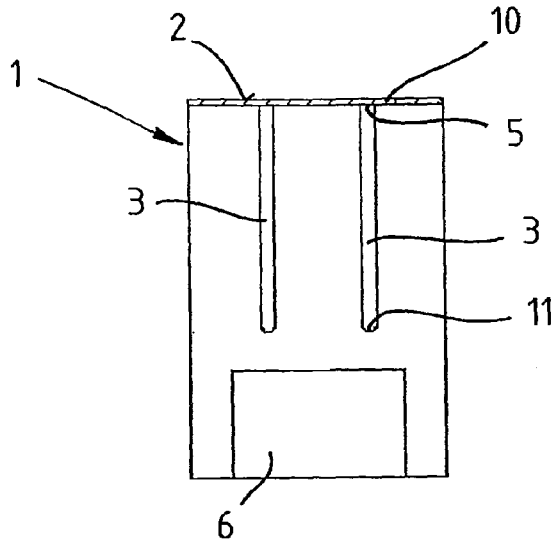
Figure 4:
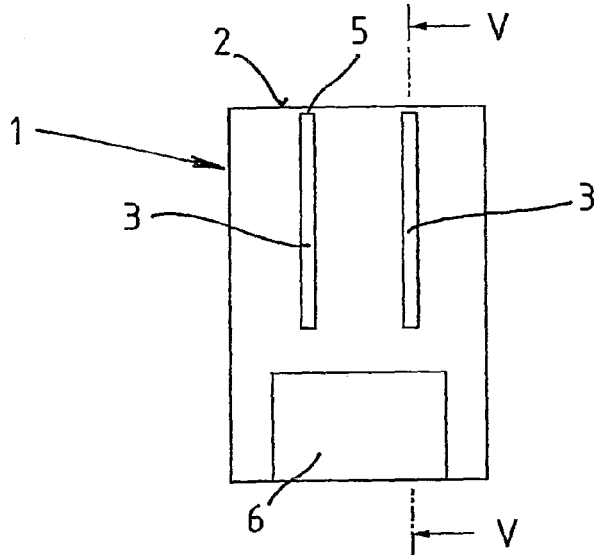
Figure 5:
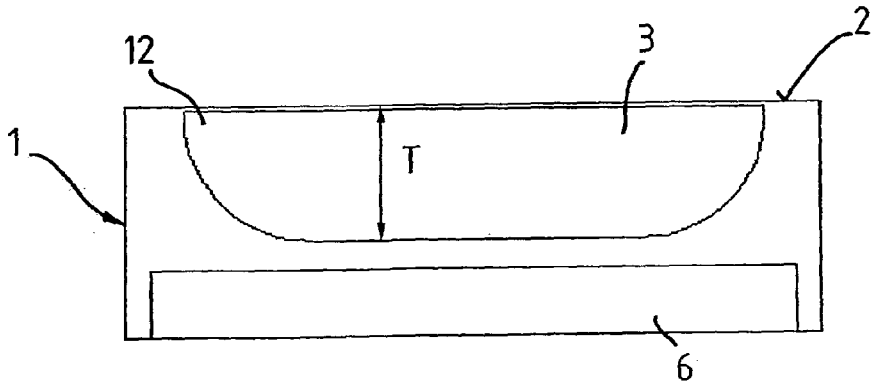
Figure 6:
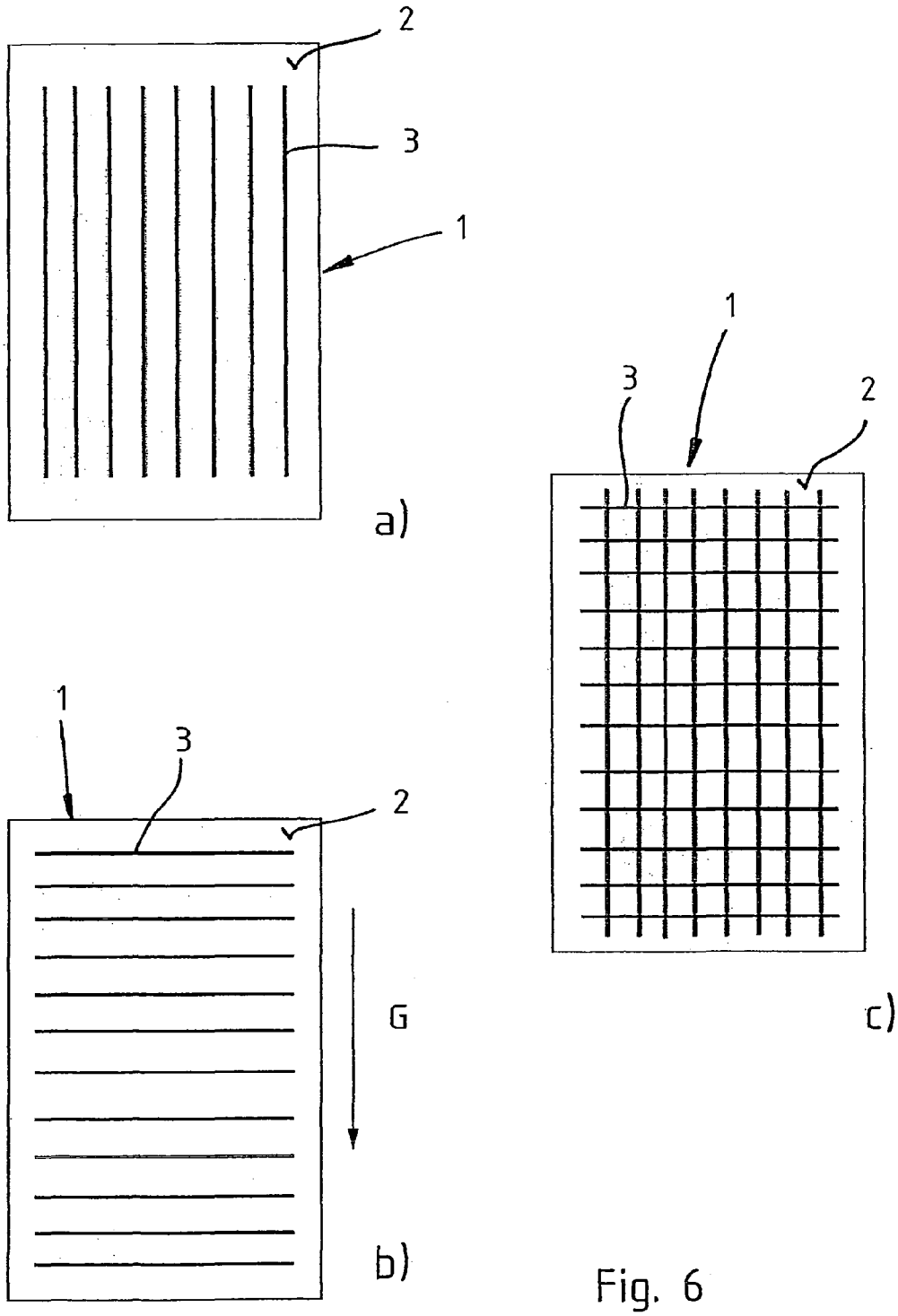

The present invention is explained below in more detail using exemplary embodiments shown in the drawings. The figures show:

FIG. 1 a cross section through a sub-range of a casting mold at room temperature;

FIG. 2 the cross section of FIG. 1 during casting operation;

FIG. 3 an additional specific embodiment of a casting mold having a coating on the casting surface;

FIG. 4 an additional specific embodiment of a casting mold having expansion joints which have been closed by a remelting method;

FIG. 5 a longitudinal section along line V-V of FIG. 4;

FIG. 6*a-c* top views onto a casting surface of a casting mold having differently oriented expansion joints.

FIG. 1 shows a small cutout of a casting mold made of a copper material, particularly in the form of a permanent mold plate of a continuous casting permanent mold.

FIG. 1 shows a cross section through a sub-range of a casting mold in the form of a permanent mold plate. Casting mold 1 has a casting surface 2 facing a metal melt that is not shown in greater detail. A plurality of expansion joints 3 is situated in casting surface 2, which run parallel to one another and are perpendicular to casting surface 2. The expansion joints 3 are configured identically and have a width B, which is so small that no metal melt penetrates into expansion joint 3 during the casting process. In this exemplary embodiment, width B amounts to 0.4 mm. Expansion joints 3 are filled up with a filler 4, in the form of graphite paste. During the casting process, this filler 4 is released from expansion joints 3. At the start of casting, it prevents the entry of metal melt into expansion joints 3.

Expansion joints 3, that are shown, are open at their opening-out side 5. They have a depth T, which is substantially larger than width B, and preferably amounts to at least 8 mm. Expansion joints 3 reach into a depth region of casting mold 1 that lies close to cooling recesses 6, which project from rear side 7 of shown casting mold 1 into casting mold 1. Cooling recesses 6 have cooling water flowing through them. Depth T of expansion joints 3 is dimensioned so that the deepest of expansion joints 3 is free of thermal stresses because of cooling in the region of cooling recesses 6. It is however unavoidable that the copper material of casting mold 1 undergoes thermal expansion near the vicinity of casting surface 2, as may be seen in FIG. 2. Since the temperature is greatest in the vicinity of casting surface 2, opening-out 8 of expansion joints 3 closes during the casting process, so that no metal melt is able to penetrate into expansion joint 3. Therefore, during the casting process, expansion joints 3 have a cross section that becomes conically narrower from the groove base on upwards.

Ideally, expansion joints 3 are positioned at a distance A from one another, which is dimensioned in such a way that distance A, measured at room temperature, plus width B, measured at room temperature, are equivalent to distance C of openings-out 8 of the expansion joints during the casting process. In other words, the condition A+B=C applies. In this state, no thermal stresses occur in the vicinity of opening-out 8, and there is consequently, no bulging of casting mold 1 in the direction towards the metal melt. During cooling, distance C of openings-out 8 decreases again to distance A at room temperature. Expansion joints 3 open again on the opening-out side, so that no crack formation takes place within casting surface 2 and casting mold 1. Sidewalls 9 of expansion joint 3 then run parallel to each other again, as shown in FIG. 1, and are no longer at an angle to each other, as shown in FIG. 2.

FIG. 3 shows a variant in which opening-out side 5 of expansion joint 3 is closed by a wear-reducing coating 10. In this variant, too, expansion joints 3 prevent crack formation of the copper materials and contribute to avoiding bulging. This works, in particular, even if coating 10 has been removed by the progressive wear of casting mold 1.

In addition, one should note in the specific embodiment of FIG. 3 that joint base 11 is rounded, as an example for all other specific embodiments. Joint base 11 may also be cornered, as may be seen in the exemplary embodiments of FIGS. 1 and 2.

The specific embodiment of FIG. 4 differs from that of FIG. 3 in that expansion joints 3 are not closed at the opening-out side by a coating 10, but rather by a remelting method, such as friction stir welding.

FIG. 5 shows a sectional representation along line V-V of FIG. 4. One may see that depth T of expansion joint 3 decreases towards its ends 12. In particular, joint base 11 is rounded to a certain extent in the longitudinal direction of expansion joint 3. The transition from the deepest part of expansion joint 3 to casting surface 2 thus does not take place abruptly but continuously.

FIGS. 6*a-c* show three different specific embodiments of a possible course of expansion joints 3. Each case involves a view onto casting surface 2. In the variant according to FIG. 6*a*, expansion joints 3 run at parallel distances to one another in casting direction G of the metal melt, which flows past the casting mold from top to bottom in the image plane. The alternative specific embodiment according to FIG. 6*b* shows expansion joints 3, which are oriented transversely to casting direction G. The variant according to FIG. 6*c* shows expansion joints 3 that cross one another, so that a chess board-like or even honeycomb-shaped pattern is created. Any other orientation of expansion joints 3 is possible. The course of the expansion joints is not absolutely necessarily linearly straight, but may be curved. Just as the course of the expansion joints is able to vary, so it is also possible to vary the depth, the width and the distance apart of expansion joints 3.

LIST OF REFERENCE NUMERALS

1—casting mold
2—casting surface
3—expansion joint
4—filler
5—opening-out side
6—cooling recess
7—rear side
8—opening out
9—sidewall
10—coating
11—joint base
12—end
A—distance apart
B—width
C—distance apart
G—casting direction
T—depth

What is claimed is:

1. A casting mold made of a copper material having a casting surface (2) that faces a metal melt, wherein at least one expansion joint (3) is situated in the casting surface (2), the at least one expansion joint (3) having a width (B) that closes during a casting process such that no metal melt penetrates into the at least one expansion joint (3);

wherein the at least one expansion joint is filled with a filler such that during the casting process the filler is released from the at least one expansion joint.

2. The casting mold as recited in claim 1, wherein the width (B) is in a range of 0.1 to 0.4 mm.

3. The casting mold as recited in claim 1, wherein a depth (T) of the at least one expansion joint (3) is dimensioned so that a lowest part of the at least one expansion joint (3) is free of thermal stresses because of cooling.

4. The casting mold as recited in claim 1, wherein a depth (T) of the at least one expansion joint (3) decreases going towards ends (12) of the at least one expansion joint (3).

5. The casting mold as recited in claim 1, wherein sidewalls (9) of the at least one expansion joint (3) run parallel to one another at room temperature or run at an angle to one another.

6. The casting mold as recited in claim 1, wherein the at least one expansion joint (3) are dimensioned in their width (B) and situated at a distance (A) from one another, in such a way that the at least one expansion joint (3) is closed to the greatest extent at an opening-out side by thermal expansion during the casting process.

7. The casting mold as recited in claim 1, wherein the casting mold (1) is a permanent mold plate, a permanent mold tube, a casting wheel, a casting roll or a pot.

8. The casting mold as recited in claim 1, wherein the at least one expansion joint (3) is situated in the vicinity of a highest temperature stress of the casting mold (1).

9. The casting mold as recited in claim 1, wherein the copper material is a CuCrZr, a CuCoBe or a CuNiBe alloy.

10. The casting mold as recited in claim 1, wherein a groove base is provided with a transition radius.

11. The casting mold as recited in claim 1, wherein the at least one expansion joint become wider in a direction transverse to a casting direction.

* * * * *